US005498268A

United States Patent [19]

Gagliardi et al.

[11] Patent Number: 5,498,268

[45] Date of Patent: Mar. 12, 1996

[54] ABRASIVE ARTICLES AND METHOD OF MAKING ABRASIVE ARTICLES

[75] Inventors: John J. Gagliardi; Jason A. Chesley, both of Hudson, Wis.

[73] Assignee: Minnesota Mining and Manufacturing Company, St. Paul, Minn.

[21] Appl. No.: 213,550

[22] Filed: Mar. 16, 1994

[51] Int. Cl.[6] ..... B24D 3/00

[52] U.S. Cl. ..... 51/294; 51/295; 51/298; 51/307

[58] Field of Search ..... 51/293, 294, 295, 51/298, 307

[56] References Cited

U.S. PATENT DOCUMENTS

| | | | |
|---|---|---|---|
| 2,237,846 | 4/1941 | Schenk | 99/450.7 |
| 3,670,467 | 6/1972 | Walker | 51/298 |
| 3,888,640 | 6/1975 | Bigorajski et al. | 51/298 |
| 4,311,489 | 1/1982 | Kressner | 51/298 |
| 4,381,188 | 4/1983 | Waizer et al. | 51/298 |
| 5,110,321 | 5/1992 | Broberg et al. | 51/295 |
| 5,201,916 | 4/1993 | Berg et al. | 51/293 |
| 5,250,085 | 10/1993 | Mevissen | 51/298 |
| 5,250,105 | 10/1993 | Gomes et al. | 106/1.11 |
| 5,269,821 | 12/1993 | Helmin et al. | 51/295 |
| 5,328,716 | 7/1994 | Buchanan | 427/121 |

FOREIGN PATENT DOCUMENTS

| | | | |
|---|---|---|---|
| WO92/05915 | 4/1992 | WIPO | B24D 11/00 |

OTHER PUBLICATIONS

Holley, Binders and Binder Systems for Agglomeration, Ferro–Tech, Wyandotte, MI, pp. 77–86 Aug. 1981.

Lignin, The Lignin Story (A Reference Guide to Specialty Chemicals), Rothschild, WI, pp. 1–19 no date.

*Primary Examiner*—Deborah Jones

*Attorney, Agent, or Firm*—Gary L. Griswold; Walter N. Kirn; Doreen S. L. Gwin

[57] ABSTRACT

Abrasive articles that comprise a plurality of abrasive particles, a plurality of erodible agglomerates, and an abrasive binder are described. The erodible agglomerates comprise a plurality of grinding aid particles adhered together by a binder comprising a lignosulfonate.

23 Claims, 2 Drawing Sheets

ABRASIVE ARTICLES AND METHOD OF MAKING ABRASIVE ARTICLES

BACKGROUND OF THE INVENTION

1. Field of the Invention

This invention relates to abrasive articles, in particular abrasive articles that comprise a plurality of abrasive particles and a plurality of erodible grinding aid agglomerates.

2. Discussion of the Art

Abrasive articles generally comprise abrasive grains secured within a binder. In a bonded abrasive, the binder bonds the abrasive grains together in a shaped mass. Typically, this shaped mass is in the form of a wheel and thus it is commonly referred to as a grinding wheel. In nonwoven abrasives, the binder bonds the abrasive grains to a lofty, open, fibrous substrate. In coated abrasives, the binder bonds the abrasive grains to a substrate or backing. Coated abrasives may include a first coated layer bonded to one side of the backing (commonly referred to as a make coating), at least one layer of abrasive grains bonded to the backing by the make coating, and a second coating layer overlaying the abrasive particles. The second coating layer commonly is referred to as a size coating; it reinforces the retention of the abrasive particles. Coated abrasives also may include an additional "supersize" coating overlaying the size coating.

Abrasive binders typically consist of a glutinous or resinous adhesive, and, optionally, additional ingredients. Examples of resinous adhesives include phenolic resins, epoxy resins, urethane resins, acrylate resins and urea-formaldehyde resins. Examples of typical additives include grinding aids, fillers, wetting agents, surfactants, pigments, coupling agents, and dyes.

The addition of grinding aids can significantly affect the chemical and physical processes of abrading metals to bring about improved performance. It is believed that grinding aids either (1) decrease the friction between the abrasive grains and the workpiece being abraded, (2) prevent the abrasive grains from "capping", i.e., prevent metal particles from becoming welded to the tops of the abrasive grains, (3) decrease the interface temperature between the abrasive grains and the workpiece, and/or (4) decrease the required grinding force. In certain grinding aid applications, such as grinding stainless steel, grinding aids significantly improve the performance of the abrasive article.

The abrasive industry is always evaluating means to improve the abrading efficiency of abrasive articles without unduly increasing their cost. It is desired to provide a means for utilizing a high concentration of grinding aid in an abrasive product without significantly reducing the strength of the binder.

SUMMARY OF THE INVENTION

In one aspect, the invention features an abrasive article having a peripheral surface adapted to contact and abrade a workpiece. The abrasive article comprises a plurality of abrasive particles, a plurality of erodible grinding aid agglomerates, and an abrasive binder in which the abrasive particles and erodible grinding aid agglomerates are dispersed. The grinding aid agglomerates comprise a plurality of grinding aid particles adhered together by a lignosulfonate binder. The abrasive particles and erodible grinding aid agglomerates can be (1) adhered together in a shaped mass by the abrasive binder (thus defining a "bonded" abrasive); (2) adhered to a backing by the abrasive binder (thus defining a "coated abrasive); or (3) adhered to the fibers of a lofty, open nonwoven web by the abrasive binder (thus defining a "nonwoven" abrasive).

Preferred grinding aids include cryolite, potassium tetrafluoroborate ($KBF_4$), polyvinyl chloride, and blends thereof. Preferred lignosulfonate binders include calcium lignosulfonate, sodium lignosulfonate, and the like.

In another aspect, the invention features erodible grinding aid agglomerates comprising a plurality of grinding aid particles adhered together by a lignosulfonate binder.

In another aspect, the invention features a method of abrading a workpiece with an abrasive article having a surface adapted to contact and abrade a workpiece. The abrasive article comprises a plurality of abrasive particles, a plurality of erodible grinding aid agglomerates comprising a plurality of grinding aid particles adhered together with a lignosulfonate binder, and an abrasive binder in which the abrasive particles and the erodible grinding aid agglomerates are dispersed. The method comprises contacting the workpiece (e.g., a metal workpiece) with the surface of the abrasive article with sufficient force (typically at least about 1 $kg/cm^2$) to abrade the workpiece.

In another aspect, the invention features a method of preparing an abrasive article. A preferred method includes (1) preparing a plurality of erodible grinding aid agglomerates comprising a plurality of grinding aid particles adhered together by a lignosulfonate binder, (2) dispersing the erodible agglomerates and a plurality of abrasive particles into an abrasive binder precursor, and (3) curing or solidifying the binder precursor.

The erodible agglomerates of the invention deliver a high concentration of the grinding aid to the abrading surface without significantly affecting the strength of the abrasive article. Lignosulfonate binders are inexpensive, non-toxic, and typically are purchased as aqueous dispersion including a high (e.g., 50 percent) solids concentration, which assists in mixing and formulation. These aqueous dispersions preferably do not contain organic solvents that can pollute the environment. Although not wishing to be bound by any theory, it is believed that the lignosulfonate binder also acts as a grinding aid. Thus, in some instances the use of lignosulfonate as a binder in erodible grinding aid agglomerates results in improved abrading performance in comparison to conventional erodible agglomerate binders.

Lignin is the generic name for the amorphous, highly polymerized product which forms the middle lamella of many plant fibers (especially woods). It contains at least four condensed molecules of coniferol. The exact molecular structure of lignosulfonate is unknown, but its basic building unit is believed to be a phenyl propane. The term "lignosulfonate", as used herein, means the sulfonate salt of lignin. Typically, lignosulfonates are produced from the waste liquor from the sulfate pulping process of wood. The molecular weight of such lignosulfonates cover a broad range. For example, some lignosulfonates have molecular weights below 1,000, while other lignosulfonates have molecular weights greater than 1,000,000.

The term "erodible", as used herein, means that the agglomerate has the ability to break down in a controlled manner, for example, by fracture due to mechanical stress and/or by dissolving fully or in part under wet grinding conditions. "Wet" means grinding conditions where a water spray or flood is used.

Coated abrasive articles commonly include a make coating and a size coating, and also can include a supersize coating. Each of these coatings include a binder. The term "abrasive binder", as used herein in the context of coated abrasive articles, means the combination of binders used in the make, size, and (if present) supersize coatings.

The term "peripheral surface", when referring to coated and bonded abrasives, means that the abrasive articles of the invention have at least one surface adapted to or capable of being adapted to contact and abrade a workpiece. When referring to a nonwoven abrasive, the term means that a plurality of exposed fibers of fiber portions form the peripheral surface.

The term "dispersed", as used herein, does not necessarily denote a uniform dispersion.

The phrase "abrasive particles", as used herein, includes both individual abrasive grains and multi-grain granules composed of a plurality of abrasive grains bound together with a binder other than a lignosulfonate binder.

Other features and advantages of the invention will be apparent from the description of the preferred embodiments thereof, and from the claims.

DESCRIPTION OF THE PREFERRED EMBODIMENTS

A preferred abrasive article is a coated abrasive that comprises a backing having an abrasive coating on one major surface. The abrasive coating comprises a plurality of abrasive particles, a plurality of erodible agglomerates including a plurality of grinding aid particles adhered together with lignosulfonate binder, and an abrasive binder in which the abrasive particles and the erodible agglomerates are adhered to the backing. The abrasive binder adheres the abrasive particles and their erodible agglomerates to the backing. FIGS. 1–5 illustrate examples of preferred coated abrasives.

Figure 1:
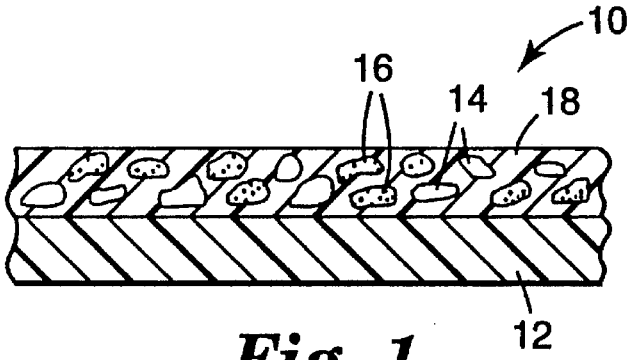
FIG. 1 is an enlarged cross-section of a coated abrasive in which the erodible agglomerates and the abrasive particles are dispersed throughout the binder.

Referring to FIG. 1, illustrated in cross-section is coated abrasive 10, which includes backing 12, abrasive particles 14, erodible grinding aid agglomerates 16, and abrasive binder 18 in which the abrasive particles and the erodible agglomerates are dispersed. The erodible agglomerates include grinding aid particles adhered together with a lignosulfonate binder.

Backing 12 has a front and back surface and can be any conventional abrasive backing that is compatible with the binder. Examples include polymeric film, primed polymeric film, cloth, paper, vulcanized fiber, reinforced thermoplastics, nonwovens, and combinations thereof. Specifically preferred backings include those in assignee's published European patent applications WO 9312911 and WO 9312912, both published Jul. 8, 1993. Both of these references describe thermoplastic backings having fibrous reinforcement therein. These applications are hereby incorporated by reference. The backing may also contain a treatment or treatments to seal the backing and/or modify some physical properties of the backing. These treatments are known in the art.

Backing 12 may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in the assignee's U.S. Pat. No. 5,201,101, which is hereby incorporated herein by reference.

Abrasive particles 14 typically have a particle size ranging from about 0.1 to 1500 micrometers, usually between about 0.1 to 400 micrometers, preferably between 0.1 to 100 micrometers, and most preferably between 0.1 to 50 micrometers. The preferred abrasive particles have a Mohs' hardness of at least about 8, more preferably above 9. Examples of suitable abrasive particles include fused aluminum oxide (which includes brown aluminum oxide, heat treated aluminum oxide, and white aluminum oxide), ceramic aluminum oxide, green silicon carbide, black silicon carbide, chromia, alumina zirconia, diamond, iron oxide, ceria, cubic boron nitride, boron carbide, garnet, and combinations thereof.

Abrasive particles 14 may include a surface coating that can have different functions. The surface coatings may increase adhesion to the binder, or alter the abrading characteristics of the abrasive particle. Examples of surface coatings include coupling agents (including aminosilanes such as gamma-aminopropyltriethoxysilane, methacrylate functional silanes such as gamma-methacryloxypropyltrimethoxysilane, and vinyl functional compounds such as vinyltriacetoxysilane), halide salts, metal oxides including silica, refractory metal nitrides, and refractory metal carbides.

Abrasive particles 14 also may include single abrasive grains bonded together to form an abrasive agglomerate. Abrasive agglomerates are described, for example, in U.S. Pat. Nos. 4,311,489, 4,652,275, and 4,799,939, which are hereby incorporated by reference.

Grinding aids that can be used in the erodible agglomerates 16 include inorganic halide salts, halogenated compounds and polymers, and organic and inorganic sulfur-containing materials. The preferred grinding aids are halide salts, particularly potassium tetrafluoroborate ($KBF_4$), cryolite ($Na_3AlF_6$), and ammonium cryolite [$(NH_4)_3AlF_6$], and halogenated polymers, particularly polyvinyl chloride. Other halide salts that can be used grinding aids include sodium chloride, potassium cryolite, sodium tetrafluoroborate, silicon fluorides, potassium chloride, and magnesium chloride.

Examples of halogenated polymers useful as grinding aids include polyvinyl halides (e.g., polyvinyl chloride) and polyvinylidene halides such as disclosed in U.S. Pat. No. 3,616,580; highly chlorinated paraffin waxes such as those disclosed in U.S. Pat. No. 3,676,092; completely chlorinated hydrocarbon resins such as those disclosed in U.S. Pat. No. 3,784,365; and fluorocarbons such as polytetrafluoroethylene and polytrifluorochloroethylene as disclosed in U.S. Pat. No. 3,869,834.

Inorganic sulfur-containing materials useful as grinding aids include elemental sulfur, cupric sulfide, molybdenum sulfide, potassium sulfate, and the like, as variously disclosed in U.S. Pat. Nos. 3,833,346, 3,868,232, and 4,475,926. Organic sulfur-containing materials for use in the invention include those mentioned in U.S. Pat. No. 3,058,819 (e.g., thiourea).

The grinding aids used in erodible agglomerates 16 are particles having an average particle size ranging from about 1 micrometer to about 100 micrometers, and more preferably ranging from about 5 micrometers to about 50 micrometers. Erodible agglomerates 16 preferably include between 50% and 99%, more preferably between 90% and 98%, grinding aid particles by weight.

The preferred lignosulfonate binders are the product of sulfate-pulping process in the paper industry. Examples include sodium lignosulfonate and calcium lignosulfonate. Erodible agglomerates 16 preferably include between 1% and 50%, more preferably between 2% and 10%, of the lignosulfonate binder by weight.

Erodible grinding aid agglomerates 16 may be made by any one of a variety of methods. In one preferred method, they are prepared by thoroughly mixing the grinding aid and the lignosulfonate binder, heating the mixture to dry it, and then crushing the cake, with appropriate screening, to provide erodible agglomerates within the desired size range. A general method to prepare the erodible agglomerates is as follows. A mixture of the grinding aid particles and lignosulfonate is prepared. Into this mixture may optionally be added any processing aids, optional additives, water, or an organic solvent. Next the mixture can be dried to remove any unwanted volatiles. The resulting dried mixture is crushed and screened to the appropriate particle size distribution. Alternatively, the mixture can be shaped either by extrusion or molding to form a shaped erodible agglomerate, as known in the art such as described in assignee's U.S. patent application U.S. Ser. No. 08/085,638 (Holmes et al.), which is hereby incorporated by reference. Likewise, before, during, or after shaping an unwanted volatile can be removed by drying. This shape can be irregular or random, or a rod, a pyramid, a cone, sphere, a cube and the like.

Erodible agglomerates may also be prepared by passing the thoroughly mixed combination of grinding aid particles and lignosulfonate binder through a pan agglomerator, pin agglomerator, a briquetter, an extruder, a roller press, a flat die press, a pellet mill, or the like.

The ratio of the average size of abrasive particles 14 to the average size of the erodible agglomerates can range from about 1:2.5 to about 1:0.5. It is preferred that the abrasive particles be about the same average size as the erodible agglomerates. The volume of an average erodible agglomerate to the volume of an average abrasive particle preferably ranges from 0.08:1 to 1.75:1, and more preferably ranges from 0.5:1 to 1:1.

Abrasive binder 18 can be derived from a binder precursor comprising any of the conventional resinous or glutinous adhesives used in coated abrasives. Examples of resinous adhesives include phenolic resins, urea-formaldehyde resins, urethane resins, acrylate resins, aminoplast resins, epoxy resins, latices and combinations thereof.

Erodible agglomerates 16 and abrasive binder 18 also can include optional additives such as fillers, fibers, lubricants, wetting agents, thixotropic agents, surfactants, pigments, dyes, antistatic agents, coupling agents, plasticizers, and suspending agents. The amounts of these materials are selected to provide the properties desired. The use of these can affect the erodability of the abrasive composite. For example, an additive can be added to make the abrasive more erodible, thereby expelling dulled abrasive particles and exposing new abrasive grains. In addition, the binder can include additional grinding aid particles that are not included in erodible agglomerates.

Coated abrasive 10 in FIG. 1 is prepared by (1) thoroughly mixing abrasive particles 14, erodible agglomerates 16, and an abrasive binder precursor; (2) coating the mixture onto backing 12; and (3) exposing the binder precursor to conditions sufficient to cure or solidify the binder precursor. Preferred exposure conditions include heat and/or radiation energy, or a combination thereof, as is known in the art.

The components (backing, abrasive particles, etc.) that are included in coated abrasive 10 also can be included in the following embodiments.

Figure 2:
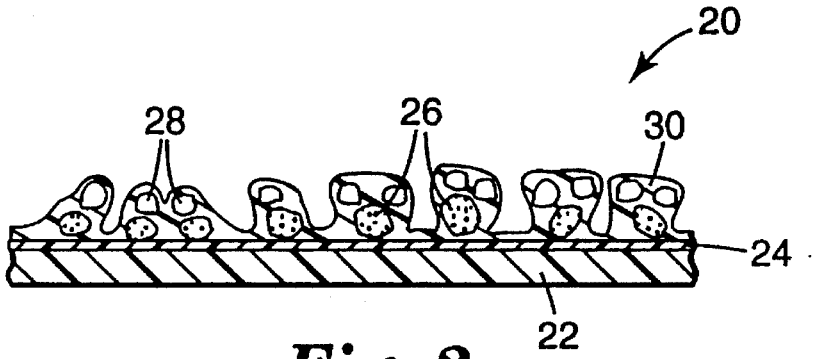
FIG. 2 is an enlarged cross-section of a coated abrasive in which the abrasive particles are located substantially over the erodible agglomerates.

Referring to FIG. 2, illustrated in cross-section is coated abrasive 20, which includes backing 22, make coating 24, erodible grinding aid agglomerates 26, abrasive particles 28 located substantially over the erodible agglomerates, and size coating 30 covering the abrasive particles. The make and size coatings can comprise the same material or different materials; in this and subsequent embodiments including multiple coatings, the coatings in combination are the abrasive binder. Coated abrasive 20 in FIG. 2 is prepared by: (1) applying a make coat precursor to the backing; (2) coating erodible agglomerates 26 onto the make coat precursor; (3) coating abrasive particles 28 over the erodible agglomerates; (4) optionally exposing the make coat precursor to conditions sufficient to partially cure or solidity the make coat precursor; (5) applying a size coat precursor 30; and (6) exposing the make and size coat precursors to conditions sufficient to fully cure or solidify the precursors.

Figure 3:
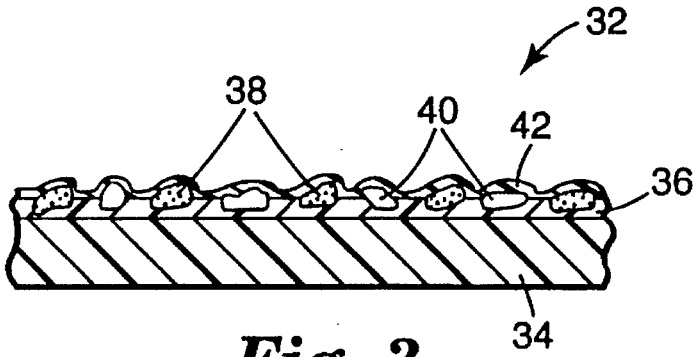
FIG. 3 is an enlarged cross-section of a coated abrasive in which the abrasive particles are located substantially in-between the erodible agglomerates.

Referring to FIG. 3, illustrated in cross-section is coated abrasive 32, which includes a backing 34, make coating 36, erodible grinding aid agglomerates 38, abrasive particles 40, and size coating 42. In this embodiment, the abrasive particles are located substantially only in between the erodible agglomerates. Coated abrasive 32 is prepared by the same general procedure as is used to prepare coated abrasive 20, except that erodible agglomerates 38 and abrasive particles 40 are coated as a mixture onto the make coat precursor.

Figure 4:
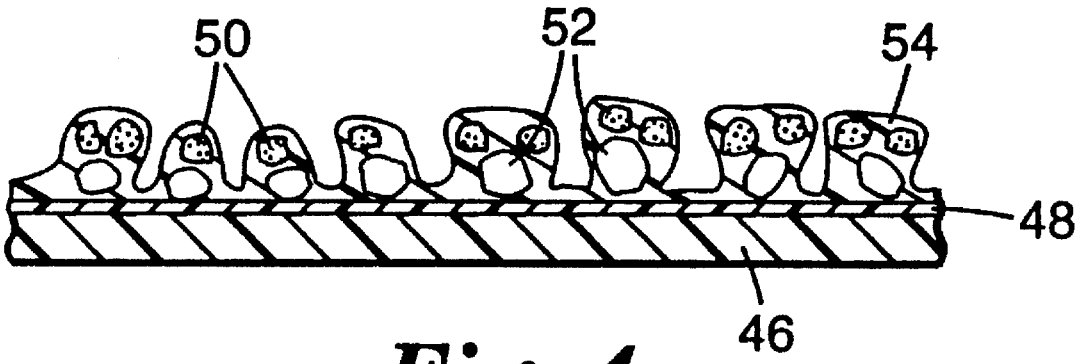
FIGS. 4 and 5 are enlarged cross-sections of coated abrasives in which the abrasive particles are located substantially underneath the erodible agglomerates.

Referring to FIG. 4, illustrated in cross-section is coated abrasive 44, which includes backing 46, make coat 48, erodible grinding aid agglomerates 50, abrasive particles 52, and size coating 54. In this embodiment, the abrasive particles are located substantially underneath the erodible agglomerates. Coated abrasive 44 is prepared by the same general procedure as is used to prepare coated abrasive 20, except that abrasive particles 52 are coated onto the make coat precursor before erodible agglomerates 50 are coated.

Figure 5:
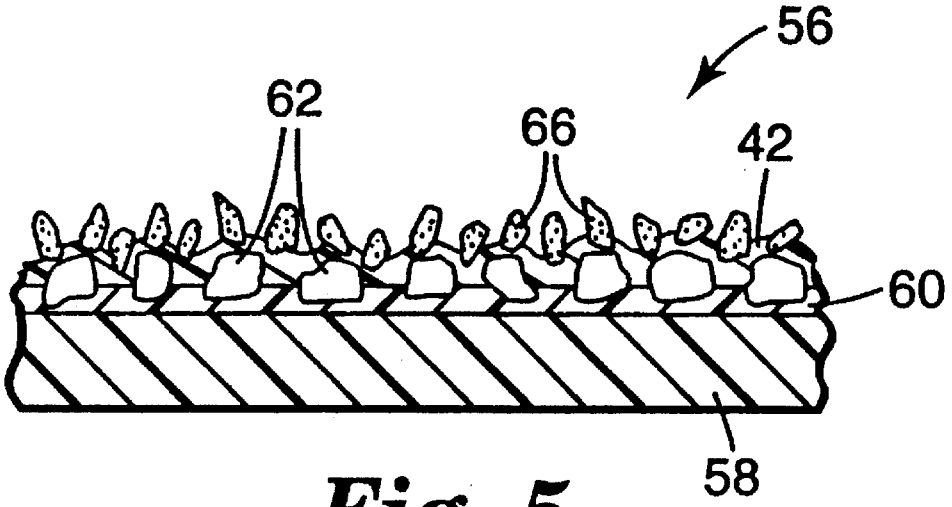

Referring to FIG. 5, illustrated in cross-section is coated abrasive 56, which includes backing 58, make coating 60, abrasive particles 62, size coating 64 overlaying the abrasive particles, and erodible grinding aid agglomerates 66 adhered to the size coating. Coated abrasive 56 is prepared by: (1) applying a make coat precursor to backing 58; (2) coating abrasive particles 62 onto the make coat precursor; (3) optionally partially curing or solidifying the make coat precursor; (4) applying a size coat precursor over the abrasive grains; (5) coating erodible agglomerates 66 onto the size coat precursor; and (6) fully curing or solidifying the binder precursors.

The coated abrasives illustrated in FIGS. 2–5 include make and size coatings. The preferred coated abrasives may also include a supersize coating covering the size coating. In these embodiments, the erodible grinding aid agglomerates optionally may be coated onto the supersize coating prior to fully curing or solidifying the supersize coat precursors. Alternatively, a supersize coating containing grinding aid particles (e.g., $KBF_4$) in non-agglomerate form may be added to the abrasive articles illustrated in FIGS. 2–5.

The erodible grinding aid agglomerates also can be incorporated into the coated abrasive articles described, for example, in U.S. Pat. No. 5,152,917, and in assignee's U.S. patent application U.S. Ser. No. 08/121,110, filed Sep. 13, 1993, both of which are hereby incorporated by reference herein. These coated abrasive articles include a non-random array of abrasive composites attached to a backing. Similarly, coated abrasives that include a random array of abrasive composites attached to a backing are described in assignee's U.S. patent application U.S. Ser. No. 08/120,300 (Hoopman et al.), which is hereby incorporated by reference. Each abrasive can include abrasive particles, the erodible agglomerates of the invention, and an abrasive binder that adheres each abrasive composite to the backing.

The coated abrasives of the invention can be used for abrading metals, including stainless steel and titanium. As used herein the term "abrading" is used generally to include grinding, polishing, finishing, and the like.

The most generic method of abrading metal workpieces includes contacting the workpiece with a peripheral surface of an abrasive article, with sufficient force to abrade the metal workpiece while the peripheral surface and workpiece are moving in relation to each other. Either the workpiece or the abrasive article is preferably stationary.

A general reference for grinding of metals is Chapter 7 of the book entitled "Coated Abrasives—Modern Tool of Industry", pp. 150–200, published by the Coated Abrasives Manufacturers' Institute in 1958. As stated therein, for each application there is an optimum combination of a particular kind of coated abrasive used in a specific grade sequence and the right type of equipment which will give the best results in terms of production, finish, and cost. Factors to be considered are the metallurgy of the workpiece, the shape, size, and condition of the workpiece, the power of the equipment to be used, type of contact Wheel used, and the desired finish.

The coated abrasive can be shaped in the form of a belt, disc, sheet, or the like.

In embodiments in which the abrasive article is a continuous abrasive belt, the choice of contact wheel, force employed, and abrasive belt speed depends on the desired rate of cut and the resulting surface finish on the workpiece, care being taken not to damage the workpiece. The contact wheel may be plain or serrated. The force between the abrasive article and the workpiece may range from 0.05 kilogram (kg) to 150 kg, typically and preferably from about 0.1 kg to about 100 kg. The belt speed may range from 305 surface meters per minute (smpm) to 3,050 smpm, more typically and preferably from about 415 smpm to about 2,134 smpm.

The following examples and test procedures will further illustrate the preferred coated abrasive articles, and the methods of making and using the same.

Test Procedure I (Endless Belts)

Coated abrasive materials converted to 203 cm by 6.3 cm endless belts were installed on a Thompson Type C12 grinding machine. The effective cutting area of the abrasive belt was 2.54 cm by 203 cm. The workpiece abraded by these belts was 304 stainless steel, 2.54 cm width by 17.78 cm length by 10.2 cm height. Abrading was conducted along the 2.54 cm by 17.78 cm face. The workpiece was mounted on a reciprocating table. Speed of the abrasive belt was 1,707 surface meters per minute. The table speed, at which the workpiece traversed, was 6.1 meters per minute. The downfeed increment of the abrasive belt was 0,003 cm/pass of the workpiece. The process used was conventional surface grinding wherein the workpiece was reciprocated beneath the rotating abrasive belt with incremental downfeeding between each pass. This grinding was carried out dry. However, as the workpiece exited the grinding interface, on each pass it was flooded with water to cool it, followed by a blast of cool air. Each belt was used until it shelled. Shelling is the premature release of the abrasive particles; shelling typically reduces or ends the useful life of the coated abrasive.

Test Procedure II (Fiber Discs)

A cured fiber disc having a diameter of 17.8 cm, with a 2.2 cm diameter center hole and a thickness of 0.76 mm was attached to an aluminum support pad and installed on a heavy flat test apparatus. The heavy flat test involved placing a workpiece in proximity to the outer periphery of the disc at the prescribed angle at the prescribed load for the prescribed time. The workpiece as a 304 stainless steel disc having a diameter of approximately 25.4 cm and a thickness of 0.18 cm. The test was conducted at a constant load (4.0 kg). The coated abrasive disc traversed at 3500 rpm. The test endpoint was 20 minutes. The 304 stainless steel disc was weighed at 2 minute intervals during testing. The weight loss associated with the 304 stainless steel disc corresponded to the amount that the coated abrasive disc cut, i.e., the efficiency of the coated abrasive disc.

Test Procedure III (Fiber Discs)

Fiber discs having a diameter of 17.8 cm, with a 2.2 cm diameter center hole and thickness of 0.76 mm were installed on a slide action testing machine. The fiber discs were first conventionally flexed to controllably break the hard bonding resins, mounted on a beveled aluminum backup pad, and used to grind the face of a 1.25 cm by 18 cm 304 stainless steel workpiece. The disc was driven at 5,500 rpm while the portion of the disc overlaying the beveled edge of the back-up pad contacted the workpiece at 5.91 kg pressure, generating a disc wear path of about 140 $cm^2$. Each disc was used to grind a separate workpiece for one minute each, for a total time of 12 minutes each.

Materials

CLS: An aqueous, 50% solids, fermented spent sulfite liquor consisting of calcium lignosulfonate having the trade designation "LIGNOSITE CX", commercially available from Georgia-Pacific Corporation, Bellingham, Wash.

SLS: Sodium lignosulfonate having the trade designation "Marasperse CBO5-4", commercially available from Ligno Tech USA, Greenwich, Conn.

SI: An aqueous, 38% solids, solution of sodium silicate with a 1.0:3.2 ratio of $NaO_2$:$SiO_2$, commercially available from VWR Scientific, Chicago, Ill.

CW: Carnauba wax, mainly triacontyl heptocosanoate having a melting range of 83° C.–88° C.

BPAW: A composition containing a diglycidyl ether of bisphenol A epoxy resin coatable from water containing approximately 60% solids and 40% water. This composition, which had the trade designation "CMD 35021", was purchased from Rhone-Poulene, Inc., Louisville, Ky. This composition also contained a nonionic emulsifier. The epoxy equivalent weight ranged from about 600 to about 700.

RPR: Resole phenolic resin with 75% solids (non-volatile).

EMI: 2-Ethyl-4-methyl imidazole, a curing agent. It had the designation "EMI-24" and was commercially available from Air Products, Allentown, Pa.

$KBF_4$:A grinding aid. 98% Pure micropulverized potassium tetrafluoroborate, in which 95% by weight passes through a 325 mesh screen (particles 44 micrometers and smaller in size will pass) and 100% by weight passes through a 200 mesh screen (particles 74 micrometers and smaller in size will pass).

CRY Cryolite (trisodium hexafluoroaluminate).

PVC Polyvinyl chloride which had the trade designation "GEON 103EPF-76", was commercially available from the Specialty Polymers & Chemicals Div. of B.F. Goodrich of Cleveland, Ohio.

IO Red iron oxide.

HP A mixture of 85% 2-methoxy propanol and 15% $H_2O$, commercially available from Worum Chemical Co., St. Paul, Minn.

AOT: A dispersing agent (sodium dioctyl sulfosuccinate), which had the trade designation "Aerosol OT" and was commercially available from Rohm and Haas Company.

General Procedure for Making Coated Abrasives (Endless Belts)

For the following examples the backing of each coated abrasive consisted of a Y weight woven polyester cloth which had a four over one weave. Each backing was saturated with a latex/phenolic resin and then placed in an oven to partially cure this resin. Next, a calcium carbonate-filled latex/phenolic resin pretreatment coating was applied to the back side of each backing. Each coated backing was heated to about 120° C. and maintained at this temperature until the resin had cured to a tack-free state. Finally, a pretreatment coating of latex/phenolic resin was applied to the front side of each coated backing and each coated backing was heated to about 120° C. and maintained at this temperature until the resin had precured to a tack-free state. Each backing made by this procedure was completely pretreated and was ready to receive a make coat.

A coatable mixture for producing a make coating for each coated backing was prepared by mixing 69 parts of 70% solids phenolic resin (48 parts phenolic resin), 52 parts non-agglomerated calcium carbonate filler (dry weight basis), and enough of a solution of 90 parts water/10 parts ethylene glycol monoethyl ether to form a make coating in each case which was 84% solids, with a wet coating weight of 155 g/m$^2$. The make coating was applied in each case via knife coating. This make coating was allowed to dry at ambient conditions overnight.

Next, grade 36 (ANSI standard B74.18 average particle size of 545 micrometers) ceramic aluminum oxide abrasive particles were drop coated onto the uncured make coatings with a weight of 827 g/m$^2$.

Then the resulting constructions received a precure of 15 minutes at 65° C. followed by 75 minutes at 88° C.

An 82% solids coatable mixture suitable for forming a size coating consisted of 32 percent RPR, 50.2 percent CRY, 1.5 percent IO, and 16.3 percent HP was then applied over the abrasive particles/make coating construction via two-roll coater. The wet size coating weight in each case was about 465 g/m$^2$. The resulting coated abrasives received a thermal cure of 30 minutes at 88° C. followed by 12 hours at 100° C.

After this thermal cure, the coated abrasives were single flexed (i.e., passed over a roller at an angle of 90° to allow a controlled cracking of the make and size coatings), then converted into 7.6 cm by 203 cm coated abrasive belts.

General Procedure for Making Coated Abrasives (Discs)

A coated abrasive disc was prepared according to the following procedure. A 0.76 mm thick vulcanized fibre backing having a 2.2 cm diameter center hole was coated with Composition C consisting of a conventional calcium carbonate filled resole phenolic resin (83% by weight solids) to form a make coat. The wet coating weight was approximately 164 g/m$^2$. Grade 36 ceramic aluminum oxide abrasive grains were drop coated onto the make coat at a weight of approximately 740 g/m$^2$. The resulting abrasive article was precured for 150 minutes at 93° C. A size composition consisting of 32% RPR, 50.2% CRY, 1.5% IO, and 16.3% HP was applied over the abrasive grains and the make coat at an average weight of approximately 699 g/m$^2$ to form a size coat. The resulting product was cured for 11-½ hours at 93° C. After this step, the coated abrasive discs were flexed and humidified at 45% RH for one week prior to testing.

General Procedure for Preparing Lignosulfonate Grinding Aid Agglomerates 1800 grams of $KBF_4$ powder was blended with 200 grams of 50% solids (aq) calcium lignosulfonate (CLS). The mixture was placed into an oven at 100° C. for at least 4 hours. Crushing and screening the resulting hardened cake produced the desired agglomerate sizes.

Example 1 and Comparative Examples A and B

The coated abrasives for Example 1 and Comparative Examples A and B generally were made according to the General Procedure for Making Coated Abrasives (Endless Belts). These examples compare the abrading characteristics of coated abrasive articles having: no $KBF_4$ grinding aid (Comparative Example A); $KBF_4$ grinding aid in a supersize coating (Comparative Example B); and $KBF_4$-containing erodible agglomerates (Example 1). Test Procedure I was utilized to test these examples. The performance results as well as mineral and $KBF_4$ (dry) coating weights are tabulated in Table 1.

Comparative Example B is identical to Comparative Example A, except that it also includes supersize coating. The supersize coating was applied by roll coating after the size coating was cured for 30 minutes at 88° C. followed by 12 hours at 100° C. The supersize coating (precursor) consisted of 29.2% BPAW, 0.35% EMI, 53.3% $KBF_4$, 14.1% water, 0.75% AOT, and 2.3% IO. This coating was cured at 115° C. for 90 minutes.

Example 1 is identical to Comparative Example A except that it also includes $KBF_4$-containing erodible agglomerates made by the Procedure for Preparing Agglomerates; the agglomerates thus include the CLS binder, which adheres the $KBF_4$ grinding aid particles together. The erodible agglomerates had an average size of about 591 micrometers and were drop coated into the uncured make resin precursor immediately after applying the ceramic $Al_2O_3$.

TABLE I

| | Ceramic $Al_2O_3$ ($g/m^2$) | $KBF_4$* ($g/m^2$) | Total Cut (g) | Specific Energy** (Es) Joules/ $mm^3$ |
|---|---|---|---|---|
| Comparative A | 827 | 0.0 | 731 | 83.3 |
| Comparative B | 786 | 99.3(SS) | 1,287 | 59.0 |
| Example 1 | 764 | 89.6 (A) | 1,487 | 55.1 |

*SS = supersize; A = agglomerate

**Specific Energy is the amount of energy needed to remove a unit volume of material ($J/mm^3$). It is calculated by dividing the horsepower by the rate of cut. Horsepower can be obtained by multiplying the measured tangential grinding force by the belt speed.

The Example 1 belt is grinding more stainless steel and this occurs at lower Es which causes less damage to the surface of the workpiece.

Examples 2 and 3 and Comparative Example C

The coated abrasives for Examples 2 and 3 and Comparative Example C were made according to the General Procedure for Making Coated Abrasives (Endless Belts). These examples compare the abrading characteristics of coated abrasive articles having: $KBF_4$ grinding aid in both a supersize coating and in an erodible agglomerate including SLS binder (Example 2); $KBF_4$ grinding aid in a supersize coating and in an erodible agglomerate including CLS binder (Example 3); and $KBF_4$ grinding aid in a supersize coating in Comparative Example C. Test Procedure I was utilized to test these examples except for these changes: belt speed was 1908 m/min., table speed was 6.1 m/min., and three separate rates of cut were used (See Table II). The performance results are tabulated in Table II.

Example 2 includes $KBF_4$-containing erodible agglomerates made by the Procedure for Preparing Agglomerates, except that SLS binder was used in place of CLS binder. The agglomerates had an average particle size of about 591 micrometers and were drop coated into the uncured supersize resin (having the composition described in Comparative Example B) immediately after applying the supersize coating.

Example 3 was formed exactly as Example 2, except that the agglomerate binder was CLS.

Comparative Example C is very similar to the construction of Comparative Example B, except that the supersize coating weights differ as shown in Table I and II.

TABLE II

| | $KBF_4$* (g/m) | Total Cut @7.74 $mm^3$/ min./ mm | Total Cut @15.48 $mm^3$/ min./ mm | Total Cut @23.23 $mm^3$/ min/ mm | Total Cut (g) |
|---|---|---|---|---|---|
| Example 2 | 101 (A)<br>101 (SS) | 2,156 | 2,789 | 3,090 | 8,035 |
| Example 3 | 101 (A)<br>101 (SS) | 2,156 | 2,261 | 2,067 | 6,453 |
| Comparative C | 201 (SS) | 2,673 | 2,672 | 2,876 | 8,221 |

*SS = supersize; A = agglomerate

The Example 2 belt removes more metal at higher rates of cut than both Example 3 and Comparative Example C.

Examples 4 and 5 and Comparative Examples D Through F

The coated abrasives for Examples 4 and 5 as well as Comparative Examples D to F were made according to the General Procedure for Making Coated Abrasives (Endless Belts). These examples compare the abrading characteristics of coated abrasive articles having: no $KBF_4$ grinding aid (Comparative Examples D and F); $KBF_4$ grinding aid in a supersize coating (Comparative Example E); $KBF_4$-containing erodible agglomerates in the make resin (Example 4); and $KBF_4$ grinding aid in both the make coating (as erodible agglomerates) and in the supersize coating (Example 5).

Test Procedure I was utilized to test these examples except for the following changes: table speed was 6.1 m/min and the downfeed increment of the abrasive belt was 0.005 cm/pass of the workpiece. The performance results as well as mineral and $KBF_4$ (dry) coating weights are tabulated in Table III.

Example 4 contains KBF agglomerates made by the Procedure for Preparing Agglomerates. These agglomerates had an average particle size of 591 micrometers and were drop coated into the uncured make resin immediately after applying the ceramic $Al_2O_3$.

Example 5 is very similar to the construction of Example 4 except a supersize has been applied by roll coating (see the supersize description for Comparative Example B).

Comparative Example D is very similar to the construction of Comparative Example A except the mineral coating weight differs as indicated in Table III.

Comparative Example E is very similar to Comparative Example B.

Comparative Example F coated abrasive was a grade 36 Regal Resin Bond Cloth coated abrasive commercially available from the Minnesota Mining and Manufacturing Company, St. Paul, Minn. Other than mineral weight variations Comparative Example F, is very similar to Comparative Examples A and D.

TABLE III

| | Ceramic $Al_2O_3$ ($g/m^2$) | $KBF_4$* ($g/m^2$) | Total Cut (g) |
|---|---|---|---|
| Example 4 | 814 | 45.3 (A) | 2,258 |
| Example 5 | 792 | {58.7 (A)<br>{171.3(SS) | 2,498 |
| Comparative D | 955 | 0.0 | 1,793 |
| Comparative E | 940 | 150.7(SS) | 2,497 |
| Comparative F | 921 | 0.0 | 1,805 |

*SS = supersize; A = agglomerate

Of particular interest in this set of tests is that there is not only far less grinding aid in Example 4 compared to Comparative E but there is also much less mineral, yet performance is comparable.

Example 6 and Comparative Example G

The coated abrasives for Example 6 and Comparative Example G were made according to the General Procedure for Making Coated Abrasives (Endless Belts). These examples compare the abrading characteristics of coated abrasive articles having $KBF_4$-containing erodible agglomerates in the make coating. Example 6 includes the CLS binder in the erodible agglomerates; Example G includes a CW binder in the agglomerates. Test Procedure I was utilized to test these examples except for these changes:

table speed was 6.1/m/min. and the downfeed increment of the abrasive belt was 0.02 cm/pass of the workpiece. The performance results and $KBF_4$ (dry) coating weights are listed in Table IV.

Example 6 contains $KBF_4$ agglomerates made by the Procedure for Preparing Agglomerates. These agglomerates had an average particle size of about 591 micrometers and were drop coated into the uncured make resin immediately after applying the ceramic $Al_2O_3$.

Comparative Example G also contains $KBF_4$ agglomerates made by the Procedure for Preparing Agglomerates, except that CW binder was used in place of CLS binder. These agglomerates had an average particle size of 591 micrometers and were drop coated into the uncured make resin immediately after applying the ceramic $Al_2O_3$.

Test Procedure I was utilized to test the example, with the following changes to the test procedure: the table speed was 6.1/m/min., and the downfeed increment of the abrasive belt was 0.02 cm/pass of the workpiece. The performance results and $KBF_4$ (dry) coating weights for the example are provided below:

TABLE IV

| | $KBF_4$* ($g/m^2$) | Total Cut (g) |
|---|---|---|
| Example 6 | 69.7 (A) | 960 |
| Comparative G | 69.7 (A | 645 |

*A = agglomerate

Examples 7–12

The coated abrasives for Example 7–12 were made according to the General Procedure for Making Coated Abrasives (Endless Belts) with these coating weights:

| | |
|---|---|
| make coating (wet) | @194 $g/m^2$ |
| agglomerates (10% binder) | @77 $g/m^2$ |
| ceramic $Al_2O_3$ | @837 $g/m^2$ |
| size coating (wet) | @542 $g/m^2$ |

The agglomerates were made by the Procedure for Preparing Agglomerates, except that the grinding aid used in Examples 8–12 was either a mixture of $KBF_4$ and PVC (Examples 8–11) or just PVC (Example 12). The agglomerates had an average particle size of about 700 micrometers and were drop coated into uncured make resin immediately after applying ceramic $Al_2O_3$. Test Procedure I was utilized to test these examples. The performance results are tabulated below:

TABLE V

| | % Weight Ratio $KBF_4$/PVC | Total Cut (g) | Specific Energy (Es) (Joules/$mm^3$) |
|---|---|---|---|
| Example 7 | 100/0 | 1232 | 9.3 |
| Example 8 | 80/20 | 1312 | 7.1 |
| Example 9 | 60/40 | 1361 | 8.2 |
| Example 10 | 40/60 | 1059 | 8.5 |
| Example 11 | 20/80 | 825 | 7.1 |
| Example 12 | 0/100 | 858 | 7.4 |

The best combination for total cut is 60% $KBF_4$ and PVC agglomerates, which performs better than the 100% $KBF_4$ agglomerates and the 100% PVC agglomerates.

Examples 13–15

The coated abrasives for Examples 13–15 were made according to the General Procedure for Making Coated Abrasives (Discs) with these coating weights:

| | |
|---|---|
| make coating (wet) | @164 $g/m^2$ |
| agglomerates (10% binder) | @74 $g/m^2$ |
| ceramic $Al_2O_3$ | @740 $g/m^2$ |
| size coating (wet) | @699 $g/m^2$ |

The agglomerates were made as described in Examples 7–12. The agglomerates had an average particle size of about 700 micrometers and were drop coated into uncured make resin immediately after applying ceramic $Al_2O_3$. Test procedure II was utilized to test these examples. The performance results are tabulated below:

TABLE VI

| | Grinding Aid in Agglomerate | Total Cut (g) |
|---|---|---|
| Example 13 | PVC | 127 |
| Example 14 | $KBF_4$ | 131 |
| Example 15 | $KBF_4$/PVC (1:1) | 163 |

This data shows that combining $KBF_4$ and PVC produces performance superior to either grinding aid alone.

Example 16 and Comparative Example H

The coated abrasives for Example 16 and Comparative Example H were made according to the General Procedure for Making Coated Abrasive (Discs) with the coating weights as indicated in the table below:

TABLE VII

| | Make Resin ($g/m^2$) | Ceramic $Al_2O_3$ ($g/m^2$) | 60/40 $KBF_4$/PVC Grinding Aid Agglomerates ($g/m^2$) | Size Resin ($g/m^2$) |
|---|---|---|---|---|
| Comparative H | 123 | 740 | 0.0 | 576 |
| Example 16 | 123 | 370 | 82 | 576 |

The agglomerates were made as indicated for Examples 7–12. The agglomerates had an average particle size of about 700 micrometers were drop coated into uncured make resin immediately after applying ceramic $Al_2O_3$. Test Procedure III was utilized to test these examples. The performance results are summarized below.

TABLE VIII

| | Grinding Aid in Agglomerate | Total Cut |
|---|---|---|
| Comparative H | None | 148 |
| Example 16 | 60/40 $KBF_4$/PVC | 261 |

Other Embodiments

Other embodiments are within the claims. For example, the abrasive particles and the erodible grinding aid agglomerates of the invention particles can be incorporated into bonded abrasive articles. The erodible grinding aid agglomerates, along with the abrasive particles, may be dispersed throughout the abrasive binder used to form the bonded abrasive articles. Alternatively, a binder precursor containing the erodible agglomerates may be applied as a peripheral surface coating on a bonded abrasive, or to voids within the bonded abrasive; the binder precursor can then be cured or solidified by known methods. The bonded abrasive can be a conventional flexible bonded abrasive employing an elastomeric polyurethane as the binder matrix. The polyurethane binder matrix may be a foam as disclosed in U.S. Pat. Nos. 4,613,345, 4,459,779, 2,972,527, 3,850,589; UK Patent Specification No. 1,245,373 (published Sep. 8, 1971); or the polyurethane binder may be a solid, as disclosed in U.S. Pat. Nos. 3,982,359, 4,049,396, 4,221,572, 4,933,373, and 5,250,085. All of these patents are hereby incorporated herein.

Detailed below is a general procedure to make a bonded abrasive incorporating the grinding aid agglomerates of the invention. The binder precursor, abrasive particles, grinding aid agglomerates, and optional additives are mixed together to form a homogeneous mixture. This mixture is then molded to the desired shape and dimensions. The binder precursor is then cured and solidified to form the bonded abrasive.

The erodible agglomerates of the invention also can be incorporated into nonwoven abrasives, such as those generally illustrated in U.S. Pat. No. 2,958,593, and those prepared according to the teachings of U.S. Pat. Nos. 4,991,362 and 5,025,596, all of which are hereby incorporated by reference. In general nonwoven abrasives included an open, lofty, three-dimensional webs of organic fibers bonded together at points where they are contacted by an abrasive binder. These webs may be roll coated, spray coated, or coated by other means with binder precursors compositions including the erodible agglomerates of the invention, and subsequently subjected to conditions sufficient to cure or solidify the resin.

Detailed below is a general procedure to make a nonwoven abrasive incorporating the grinding aid agglomerates of the invention. The binder precursor, abrasive particles, grinding aid agglomerates, and optional additives are mixed together to form a homogeneous mixture. This mixtures is then sprayed or coated into a fibrous, lofty, nonwoven substrate. The binder precursor is then cured and solidified to form the nonwoven abrasive.

We claim:

1. An abrasive article having a surface adapted to contact and abrade a workpiece, the abrasive article comprising (a) a plurality of abrasive particles, (b) a plurality of erodible agglomerates comprising a plurality of grinding aid particles adhered together with a lignosulfonate binder, and (c) a binder in which said abrasive particles and said erodible agglomerates are dispersed.

2. The abrasive article of claim 1, wherein said lignosulfonate binder is selected from the group consisting of calcium lignosulfonate and sodium lignosulfonate.

3. The abrasive article of claim 1, wherein said grinding aid particles are selected from the group consisting of waxes, organic halides, halide salts, metals, and metal alloys.

4. The abrasive article of claim 1, wherein said grinding aid particles are polyvinyl chloride.

5. The abrasive article of claim 1, wherein said grinding aid particles are potassium tetrafluoroborate.

6. The abrasive article of claim 1, wherein said erodible agglomerate comprises between about 50% and 99% of said grinding aid particles by weight.

7. The abrasive article of claim 1, wherein said grinding aid particles comprise a mixture of potassium tetrafluoroborate and polyvinyl chloride.

8. The abrasive article of claim 1, wherein said erodible agglomerates are shaped.

9. A coated abrasive article having a surface adapted to contact and abrade a workpiece, said coated abrasive article comprising a backing having a major surface, a plurality of abrasive particles, a plurality of erodible agglomerates comprising a plurality of grinding aid particles adhered together with a lignosulfonate binder, and a binder in which said abrasive particles and said erodible agglomerates are dispersed and which bonds said abrasive particles and said erodible agglomerates to said major surface of said backing.

10. The coated abrasive article of claim 9, wherein said erodible agglomerates are located substantially only above said abrasive particles.

11. The coated abrasive article of claim 9, wherein said erodible agglomerates are located substantially only below said abrasive particles.

12. The coated abrasive article of claim 9, wherein said erodible agglomerates are located substantially only next to said abrasive particles.

13. The coated abrasive article of claim 9, wherein said lignosulfonate binder is selected from the group consisting of calcium lignosulfonate and sodium lignosulfonate.

14. The coated abrasive article of claim 9, wherein said grinding aid is selected from the group consisting of waxes, organic halides, halide salts, metals, and metal alloys.

15. The coated abrasive article of claim 9, wherein said grinding aid particles are polyvinylchloride.

16. The coated abrasive article of claim 9, wherein said grinding aid particles are potassium tetrafluoroborate.

17. The coated abrasive article of claim 9, wherein said grinding aid particles are a mixture of potassium tetrafluoroborate and polyvinyl chloride.

18. The coated abrasive article of claim 9, wherein said erodible agglomerate is shaped.

19. A bonded abrasive article having a peripheral surface adapted to contact and abrade a workpiece, said bonded abrasive article comprising a plurality of abrasive particles, a plurality of erodible agglomerates comprising a plurality of grinding aid particles adhered together by a lignosulfonate binder, and an abrasive binder in which said abrasive particles and said erodible agglomerates are dispersed and which bonds said abrasive particles and said erodible agglomerates together to form a shaped mass.

20. The bonded abrasive article of claim 19, wherein said grinding aid particles are selected from the group consisting of cryolite, potassium tetrafluoroborate, and polyvinyl chloride.

21. A nonwoven abrasive article having at least one major surface and an interior region, said article comprising an open, lofty web of organic fibers, a plurality of abrasive particles, a plurality of erodible agglomerates comprising a plurality of grinding aid particles adhered together by a lignosulfonate binder, and an abrasive binder in which said abrasive particles and said erodible agglomerates are dispersed and which binds said abrasive particles and said erodible agglomerates to said open, lofty web.

22. The nonwoven abrasive article of claim 21, wherein said grinding aid particles are selected from the group consisting of cryolite, potassium tetrafluoroborate, and polyvinyl chloride.

23. A method of making an abrasive article having a surface adapted to contact and abrade a workpiece, said method comprising the steps of:

preparing erodible agglomerates comprising a plurality of grinding aid particles adhered together with a lignosulfonate binder;

providing a plurality of abrasive particles;

dispersing said erodible agglomerates and said abrasive particles in an abrasive binder precursor; and solidifying said binder precursor.

* * * * *